US006684964B2

(12) United States Patent
Ha

(10) Patent No.: US 6,684,964 B2
(45) Date of Patent: Feb. 3, 2004

(54) HAMMER DRILL

(76) Inventor: Bob B. Ha, 8111-85 Ave., Edmonton, Alberta (CA), T6C 1G4

( * ) Notice: Subject to any disclaimer, the term of this patent is extended or adjusted under 35 U.S.C. 154(b) by 0 days.

(21) Appl. No.: 10/173,436

(22) Filed: Jun. 18, 2002

(65) Prior Publication Data

US 2003/0230422 A1 Dec. 18, 2003

(51) Int. Cl.[7] ..... B25D 11/00

(52) U.S. Cl. ..... 173/29; 173/109; 173/93.5; 173/205

(58) Field of Search ..... 173/178, 29, 109, 173/205, 122, 124, 93, 93.5, 48, 93.6, 104, 114

(56) References Cited

U.S. PATENT DOCUMENTS

| | | | | | |
|---|---|---|---|---|---|
| 1,665,173 | A | | 4/1928 | Misener | |
| 2,942,852 | A | | 6/1960 | Muthmann | 255/43 |
| 2,974,533 | A | * | 3/1961 | Demo | 173/205 |
| 3,133,602 | A | | 5/1964 | Fulop | 173/109 |
| 3,149,681 | A | | 9/1964 | Drew | 173/97 |
| 3,163,237 | A | * | 12/1964 | Fulop | 173/109 |
| 3,363,700 | A | * | 1/1968 | Bogusch, Jr. | 173/205 |
| 3,724,237 | A | | 4/1973 | Wood | 64/4 |
| 4,111,060 | A | | 9/1978 | Nerini | 74/56 |
| 4,450,919 | A | | 5/1984 | Cousineau | 173/29 |
| 4,489,792 | A | | 12/1984 | Fahim et al. | 173/48 |
| 4,820,088 | A | * | 4/1989 | Ooki et al. | 173/104 |
| 5,287,582 | A | * | 2/1994 | Kawai et al. | 173/205 |
| 5,458,206 | A | | 10/1995 | Bourner et al. | 173/178 |
| 5,653,294 | A | | 8/1997 | Thurler | 173/48 |
| 5,669,453 | A | * | 9/1997 | Akazawa | 173/124 |
| 5,704,433 | A | | 1/1998 | Bourner et al. | 173/48 |
| 5,711,380 | A | | 1/1998 | Chen | 173/48 |
| 5,820,312 | A | | 10/1998 | Stock et al. | 408/17 |
| 5,908,076 | A | | 6/1999 | Marcengill et al. | 173/93 |
| 6,000,478 | A | * | 12/1999 | Hsiao | 173/205 |
| 6,089,330 | A | | 7/2000 | Miescher et al. | 173/132 |
| 6,138,772 | A | | 10/2000 | Miescher et al. | 173/93.5 |
| 6,152,242 | A | | 11/2000 | Chung | 173/48 |
| 6,213,222 | B1 | | 4/2001 | Banach | 173/1 |
| 6,230,819 | B1 | | 5/2001 | Chen | 173/48 |
| 6,286,611 | B1 | | 9/2001 | Bone | 173/216 |

* cited by examiner

*Primary Examiner*—Scott A. Smith
(74) *Attorney, Agent, or Firm*—Anthony R. Lambert

(57) ABSTRACT

A hammer drill with rolling contact at the contact surfaces for transmission of axial force between a drive shaft and hammer shaft. In the case of ball bearings, point contact is obtained. In the case of roller bearings, line contact is obtained. The area of contact is thus close to zero as opposed to a relatively large area in engagement systems using toothed surfaces. Use of point or line contact reduces heat generation and reduces energy loss due to friction.

20 Claims, 4 Drawing Sheets

HAMMER DRILL

BACKGROUND OF THE INVENTION

Hammer drills are known in which rotation of toothed surfaces against each other causes a hammering action. Also, in U.S. Pat. Nos. 3,149,681 and 3,133,602, rotary impact hammers with a ball on tooth engagement provide for a hammering action only in one direction of rotation. A ball on tooth engagement also tends to wear a groove in the tooth, which tends to create a wide contact area between ball and tooth. Together with the immobility of the tooth surface, the wide contact area increases friction losses and heating of the tool.

SUMMARY OF THE INVENTION

The present invention provides a hammer drill with rolling contact at the contact surfaces for transmission of axial force between a drive shaft and hammer shaft. In the case of ball bearings, point contact is obtained. In the case of roller bearings, line contact is obtained. The area of contact is thus close to zero as opposed to a relatively large area in engagement systems using toothed surfaces. Use of point or line contact reduces heat generation and reduces energy loss due to friction.

In some prior art products, a release clutch is used to release torque when pressure is critically increased and to prevent engagement parts from shear. In the case of a hammer drill with rolling contact, relatively low torque generators may be used where the torque does not exceed shearing stresses. The hammer drill of the present invention does not require the release clutch because it provides its function by rolling friction. When torque increases, the rotating bearing elements in the drive assembly are pushing the rotating bearing elements in the hammer assembly, thus separating the hammer assembly from the drive assembly and releasing the torque. This repetitive action also generates a hammering effect. The contact points between the rotating bearing elements are between 0 and 90 degrees to the tool axis. This offset makes the shearing component of the reaction force to rotate the rotating bearing elements inside the cavities and its axial component makes rotating bearing elements climb on each other.

To provide easier assembly and better interaction control between driver half and hammer half of the hammer drill, the bearing holders are provided by a plate with cavities backed up with a back plate. Rotating bearing elements, preferably balls, inserted into the cavities are exposed above the front surface of the cavity plate. The rotating bearing elements are prevented from axial motion in relation to the bearing holder, but are allowed to rotate freely within the cavities of the bearing holder.

The balls of one bearing holder may be fewer in number than the balls of the other bearing holder, and the balls of one bearing holder may be radially offset in relation to the balls of the other bearing holder. An on-off switch is also provided to turn the hammering action on and off.

These and other aspects of the invention are described in the detailed description of the invention and claimed in the claims that follow.

BRIEF DESCRIPTION OF THE DRAWINGS

There will now be described preferred embodiments of the invention, with reference to the drawings, by way of illustration only and not with the intention of limiting the scope of the invention, in which like numerals denote like elements and in which.

DETAILED DESCRIPTION OF PREFERRED EMBODIMENTS

In this patent document, the word comprising" is used in its non-limiting sense to mean that items following the word in the sentence are included and that items not specifically mentioned are not excluded. The use of the indefinite article "a" in the claims before an element means that one of the elements is specified, but does not specifically exclude others of the elements being present, unless the context clearly requires that there be one and only one of the elements.

Figure 1:
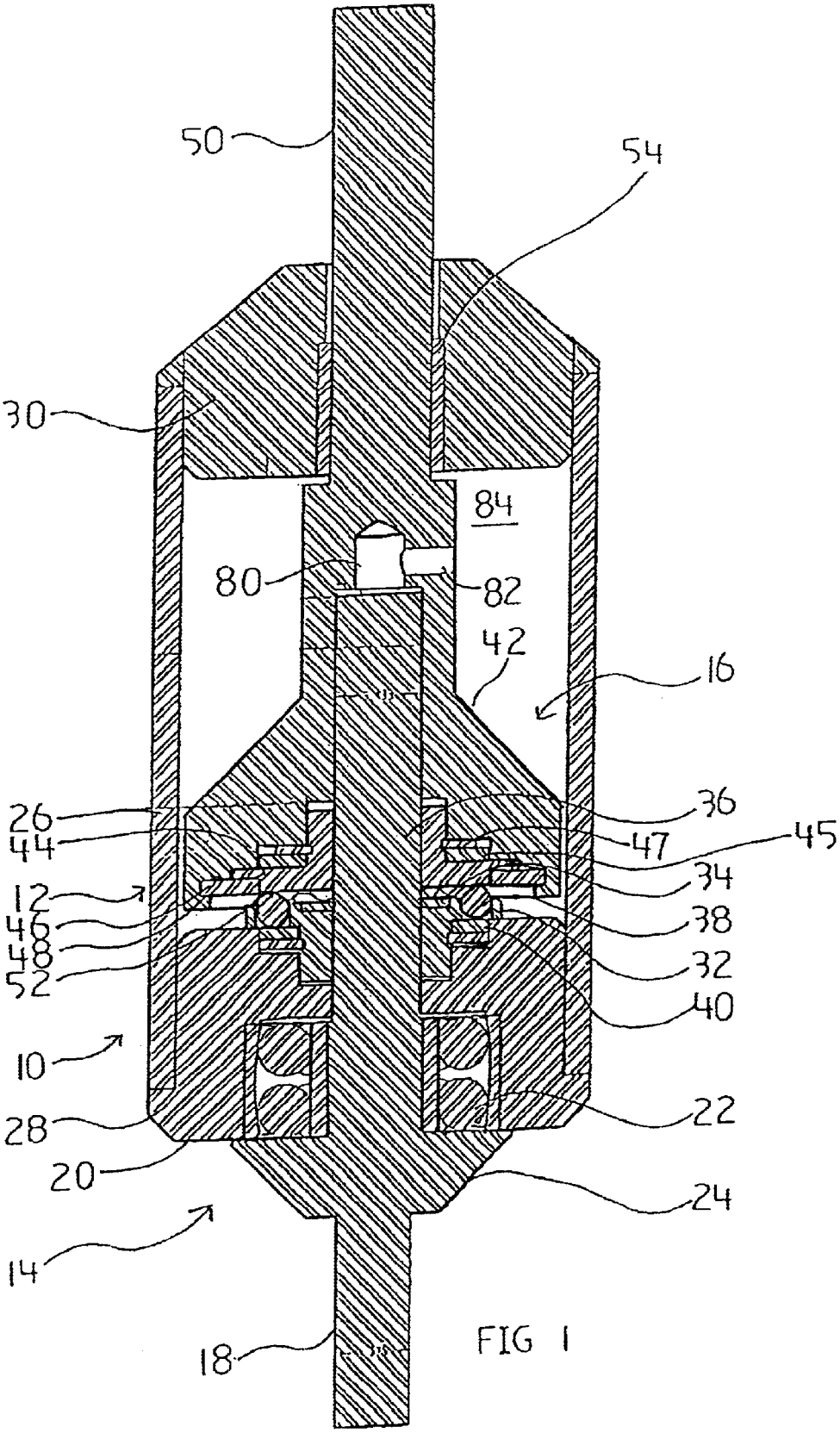
FIG. 1 is a section through a hammer drill according to the invention.

Referring to FIG. 1, there is shown an adapter 10 for a hammer drill, which includes two subassemblies mounted within a housing 12. A driver assembly 14 is directly connected to the chuck of a drill or power tool (not shown) and transfers torque from drill to a hammer assembly 16. The hammer assembly 16 converts received torque into torque and axial stroke motion. The drive assembly 14 may be formed as an integral part of a power tool.

The driver assembly 14 includes a drive shaft 18 with one end having hexagonal shape in cross-section for connection into a chuck (not shown) of a conventional power tool, and another end oblong shape in cross-section for connection with the hammer assembly 16. The middle section of the drive shaft 18 is round in section and has a step 20 for fitting a roller bearing 22 that supports the drive shaft 18 within the housing 12 for rotation relative to the housing 12. A cone shaped extension 24 covers roller bearing 22. The housing 12 is formed of a cylindrical outer case 26, a bearing housing 28 and end cup 30. Bearing housing 28 is a cylinder shaped part, and has an opening for fitting roller bearing 22 and has a round opening, partially flattened with a flat portion to create a D-shape, for positioning a bearing holder or ball holder cassette 32. A snap ring 34 engages a groove 36 on the drive shaft 18 to secure the bearing holder 32 in place and fixed axially in relation to the drive shaft 18, while the bearing holder 32 is fixed rotationally in relation to the housing 12.

The bearing holder 32 fits in the D-shaped opening of bearing housing and has 12 circular distributed cavities for positioning 12 balls 38. A back plate 40 is inserted on the drive shaft 18 between bearing housing 28 and bearing holder 32, and the back plate may be secured by a snap ring 41. Back plate 40 is made from hardened steel to protect the bearing housing 28 from impact wearing due to action of the balls 38.

The hammer assembly 16 includes a hammer shaft 42, which is cylindrically shaped. The hammer shaft has an oblong profile cavity for connection with the drive shaft 18. The matching sections of the drive shaft 18 and hammer shaft 42 permit the shafts to rotate together while allowing relative axial movement between them. Hammer shaft 42 also has a D-shape opening for inserting a bearing holder or ball cassette 44. A snap ring 46 is received in a snap ring groove 48 for securing the ball holder 44 on the hammer shaft 42, so that the bearing holder is held axially and rotationally stationary in relation to the hammer shaft 42. The working end 50 of the hammer shaft 42 is hexagonal shaped for receiving a drill bit.

Bearing holder 44 has for 12 circular distributed cavities for positioning 12 balls 52, with the balls 52 backed up by back plate 45. The back plate 45 may be secured by snap ring 47. End cup 30 of the housing 12 is cylindrically shaped for locating a bushing 54 that permits relative rotational movement of housing 12 in relation to hammer shaft 42. Both the drill assembly 14 and the hammer assembly 16 are secured within the housing 12 formed by shell 26, bearing housing 28 and end cup 30 by suitable means such as threads, snap lock or glue.

Drive shaft 18 receives torque from a source (portable drill or electric motor), and transfers torque to hammer shaft 42. Bearing holder 32 remains fixed in motion relative to the housing 12 by virtue of the D shape of the bearing holder 32 within the D shaped opening in bearing housing 28. Bearing housing 28 stays steady in relation to the housing 12 due to threaded connection of the bearing housing 28 to the outer casing 26. Balls 38 are free to rotate in the cavities in the bearing holder 32. Bearing holder 32 is held against axial movement on the drive shaft 18 by snap ring 34.

Bearing holder 44, inserted in hammer shaft 42 is secured by snap ring 46, and stays steady relative to hammer shaft 42. When hammer shaft 42 rotates, balls 52 in the bearing holder 44 rotate with the hammer shaft 42 about the central longitudinal axis of the hammer shaft 42. With axial compression on the drive shaft 18 and hammer shaft 42, the balls 38 are initially located in gaps between balls 52. The balls 38 should not contact the surface of the bearing holder 44 between the balls 52, and the balls 52 should not contact the surface of the bearing holder 32 between the balls 38. Rather, at the point of minimum separation between the bearing holder 38 and bearing holder 52, the balls 38 should rest on balls 52 with point contact, each ball of one bearing holder resting on two balls of the other bearing holder. As the hammer shaft 42 rotates, pulling the bearing holder 44 with it, the balls 38 climb over the balls 52, pushing the hammer shaft 42 away, and then sink down between the balls 52 under axial compression. The axial displacement is a function of the ball size and ball separation. If there are twelve balls 38 on bearing holder 32, and eight balls 52 on bearing holder 44, the stroke of the hammer shaft 42 is repeated 12 times per revolution to generate a hammer action.

Figure 2A:
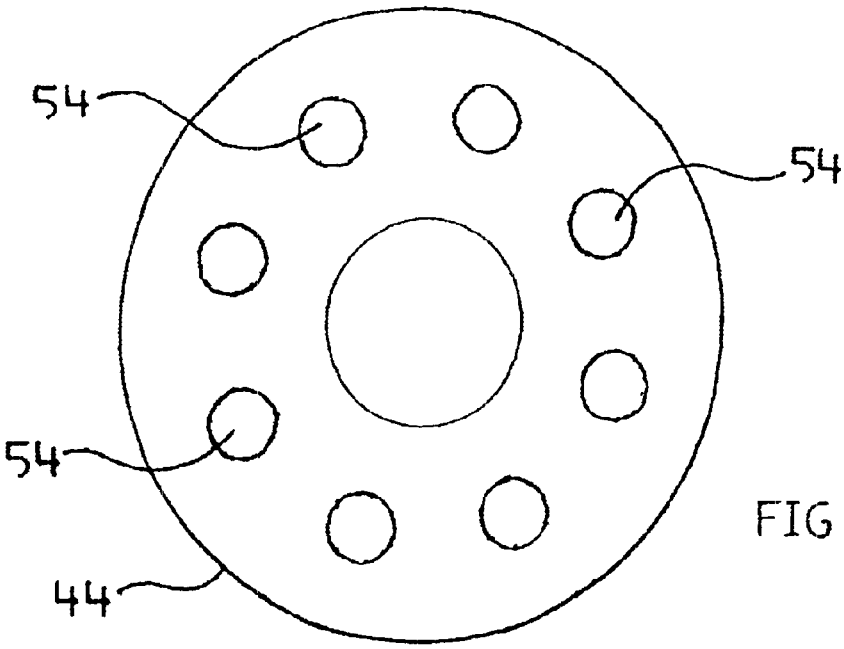
FIGS. 2A and 2B are schematics showing relative ball positions of balls used in the hammer drill of FIG. 1.
Figure 2B:
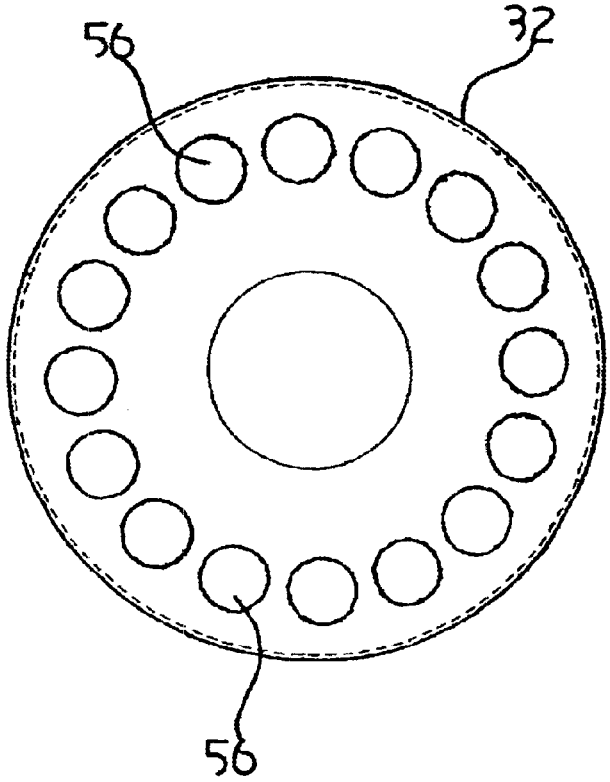
Figure 3:
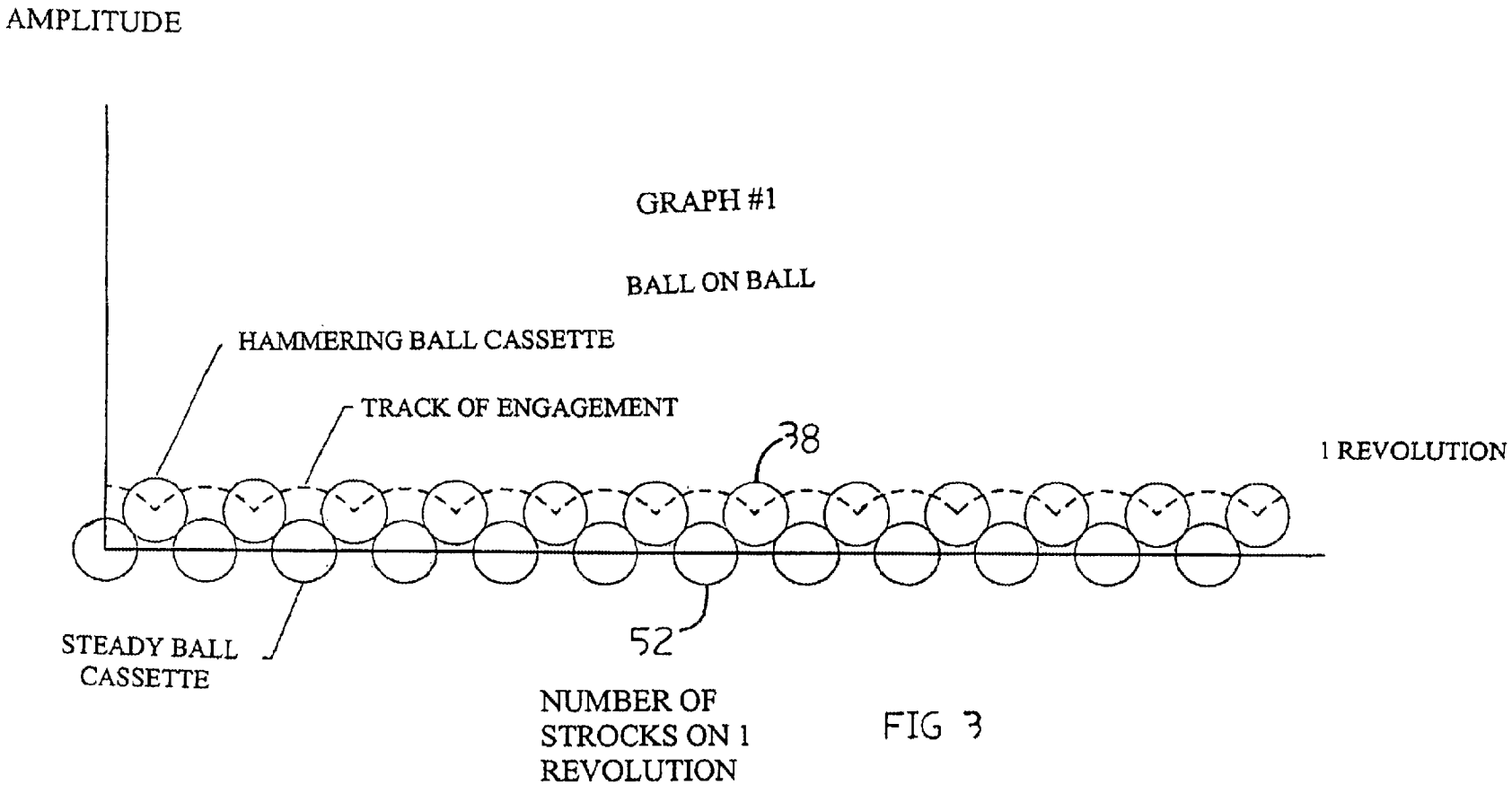
FIG. 3 is a graph showing relative ball movement in the hammer drill adapter of FIG. 1, for one revolution.

One of both of the sets of balls 38, 52 may be replaced by rollers, for example conical rollers, with line contact, roller to roller or point contact, ball to roller. Although it is possible for one set of balls to be replaced by rollers, it is preferable to use either balls in both bearing holders or rollers in both bearing holders to reduce manufacturing costs. The term rotating bearing elements includes both rollers and balls. As shown in FIG. 2A, bearing holder 44 may have 8 circular cavities 54 for receiving the balls 52. As shown in FIG. 2B, bearing holder 32 may have 12 circular cavities 56 for receiving balls 38. The balls 38, 52 may be offset radially relative to each other, for example as shown in FIGS. 2A and 2B so that for example the centers of the cavities 54 may be closer to the center of the bearing holder 44 than are the cavities 56 in relation to the center of the bearing holder 32, and vice versa. The resulting pattern of movement of the balls 38, 52 is shown in FIG. 3.

Figure 4:
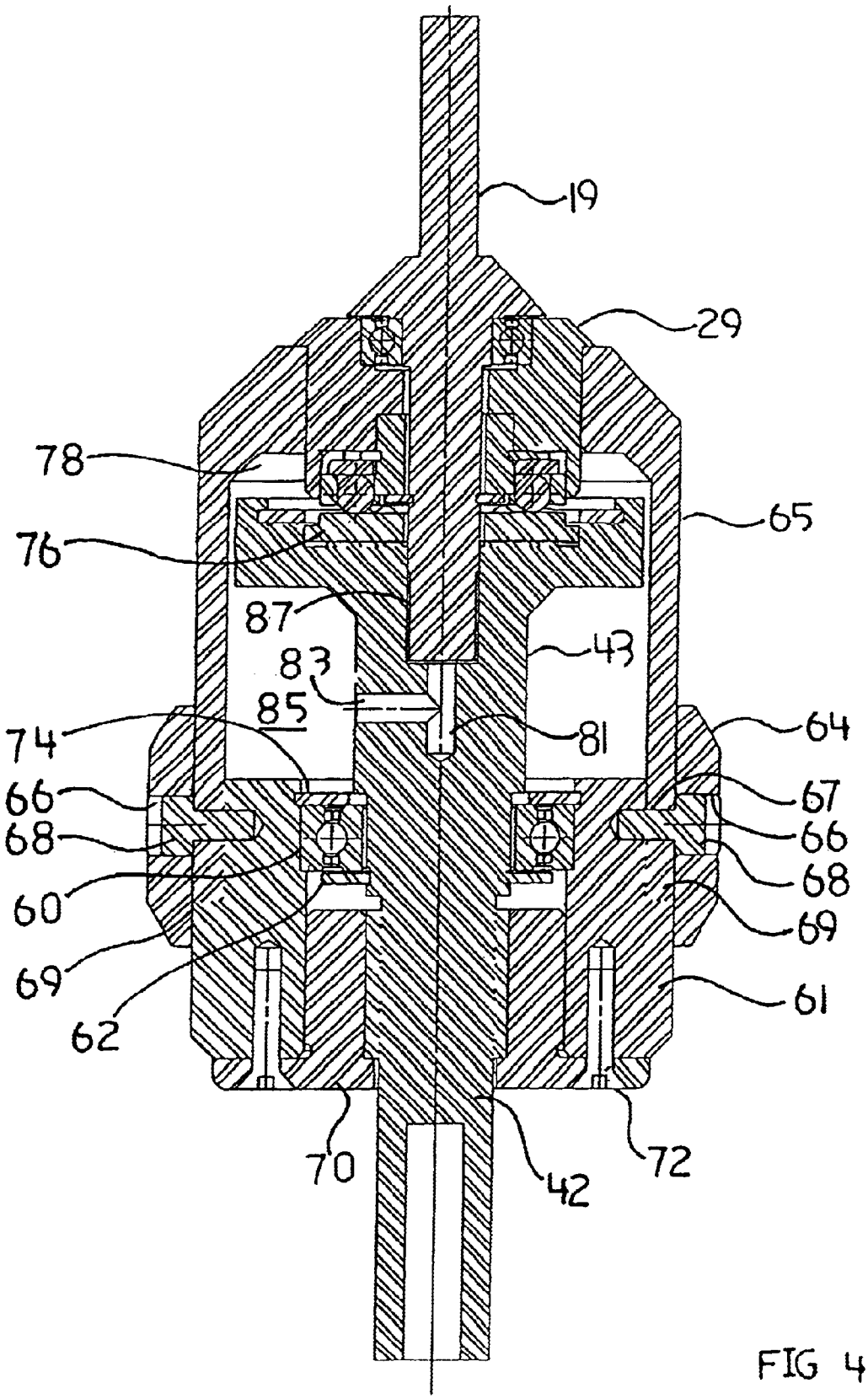
FIG. 4 is a section through a second embodiment of a hammer drill according to the invention.

To allow separate operation of the hammer drill adapter in both a rotary drilling action and a hammer action, an on-off device is provided as shown FIG. 4. In FIG. 4, bearing 60 is mounted with loose fit on hammer shaft 43 inside bearing housing 61 and is secured by snap ring 62. On/off collar 64 fits over housing casing 65, and has four threaded holes 66 distributed equally around its periphery. Pins 68 thread into the holes 66 and fit through angular slots 69 at 45 degrees when viewed sideways in the housing casing 65 and into holes 67 in the bearing housing 61. End cap 70 is secured to the bearing housing 61 by screws 72, and together with the bearing housing 61, housing casing 65 and bearing housing 29, forms a housing for retaining drive assembly 19 and hammer shaft 43. Bearing 60 press fits inside bearing housing 61 and is secured by snap ring 74.

To switch off hammering action, collar 64 is rotated at a 45 degree angle in relation to the housing casing 65, pulling bearing housing 61 and hammer shaft 43 away from the drive assembly 19. As a result, the balls of respective bearing holders 76 and 78 disengage, thus terminating the hammering action, but permitting drilling since drive assembly 19 remains engaged with hammer shaft 43 for the transfer of torque.

Lubrication between hammer shaft 42 and drive shaft 18 in FIG. 1, and between hammer shaft 43 and drive assembly 19 in FIG. 4, is provided by respective cavities 80, 81 at the end of hammer shafts 42, 43, communicating with holes 82, 83 drilled in the hammer shafts 42, 43 perpendicularly to the center axis of the hammer shafts, which holes 82, 83 lead out to oil reservoirs 84, 85. Two small grooves 87 (FIG. 4), not shown in FIG. 1, are added along hammer shafts 42, 43. When hammer shafts 42, 43 move forward, they create a vacuum effect that sucks grease from reservoirs 84, 85 and transfers grease through grooves on frictional surface.

The use of ball bearing or roller bearing engagement (BBE) is to reduce friction, which generates heat and results in loss of energy. Here is a formula to calculate energy generated by friction:

$E=K\times F\times A$

Where F—is the acting force

A—is the area of contact

K—is the friction coefficient

As we can see from the given equation, we need to minimize any of the given components to achieve the minimum energy (E). Acting Force is a result of pressure applied by operator through the tool on the drilling surface and it cannot be minimized. Friction Coefficient is a function of materials, surface grade and action character (dragging or rolling). In case BBE we are minimizing K because:

a) The balls have a smoother surface than the teeth in Tooth & Tooth Engagement (TTE);

b) BBE provides rolling action as opposed to dragging in TTE.

As we can see, K in BBE is significantly smaller than in TTE.

The design shown is suited to the commercial market. For a consumer hammer drill adapter, it is preferred to use a sleeve bearing for the ball bearing 22, and the cone shaped cover 24 may be smaller. In addition, the balls may be installed directly on the bearing housing, drive shaft or hammer shaft, without use bearing cassettes. In this case, the material of the bearing housing, drive shaft or hammer shaft supporting the balls is the bearing holder referred to in the claims. In addition, instead of an oblong shaped connection between the drive shaft and hammer shaft, one or the other may be keyed and the other slotted to effect a non-rotating connection between hammer shaft and drive shaft.

A person skilled in the art could make immaterial modifications to the invention described in this patent document without departing from the essence of the invention.

What is claimed is:

1. A hammer drill adapter, comprising:

a housing;

a drive shaft supported by bearings within the housing for rotation relative to the housing and the drive shaft having an axis;

a first set of rotating bearing elements supported within the housing and fixed in motion relative to the housing, the first set of rotating bearing elements distributed in a plane perpendicular to the axis of the drive shaft;

a hammer shaft supported within the housing for axial and rotational movement relative to the housing, the drive shaft connected to the hammer shaft to drive the hammer shaft while allowing axial movement between the drive shaft and hammer shaft;

a second set of rotating bearing elements fixed on one of the drive shaft and the hammer shaft for rotation with the one of the drive shaft and the hammer shaft, the second set of rotating bearing elements distributed in a plane perpendicular to the axis of the drive shaft; and the first set of rotating bearing elements and the second set of rotating bearing elements facing each other within the housing and engaging each other to impart a hammer action on the hammer shaft as the drive shaft and hammer shaft rotate with each other in the housing under axial load.

2. The hammer drill adapter of claim 1 in which the rotating bearing elements of at least one of the first set of rotating bearing elements and the second set of rotating bearing elements are balls.

3. The hammer drill adapter of claim 1 in which the rotating bearing elements of each of the first set of rotating bearing elements and the second set of rotating bearing elements are balls.

4. The hammer drill adapter of claim 1 in which the rotating bearing elements of the first set of rotating bearing elements are radially offset in relation to the rotating bearing elements of the second set of rotating bearing elements.

5. The hammer drill adapter of claim 1 in which the rotating bearing elements of the one of the first set of rotating bearing elements and the second set of rotating bearing elements are fewer in number than the rotating bearing elements of the other of the first set of rotating bearing elements and the second set of rotating bearing elements.

6. The hammer drill adapter of claim 1 in which axial forces are communicated from the drive shaft to the hammer shaft only through contact between the rotating bearing elements of the first set of rotating bearing elements and the second set of rotating bearing elements.

7. The hammer drill adapter of claim 6 in which contact between the rotating bearing elements of the first set of rotating bearing elements and the rotating bearing elements of the second set of rotating bearing elements occurs at multiple point contacts.

8. The hammer drill adapter of claim 1 further comprising a disengagement mechanism for disengaging the rotating bearing elements of the first set of rotating bearing elements from the rotating bearing elements of the second set of rotating bearing elements.

9. The hammer drill adapter of claim 1 in which the drive shaft is the drive shaft of a power tool.

10. The hammer drill adapter of claim 1 in which the second set of rotating bearing elements is fixed on the hammer shaft.

11. A hammer drill adapter, comprising:

a housing;

a drive shaft supported by bearings within the housing for rotation relative to the housing and the drive shaft having an axis;

a first bearing holder supported by the housing and fixed in motion relative to the housing, the first bearing holder incorporating plural rotating bearing elements distributed around the first bearing holder in a plane perpendicular to the axis of the drive shaft;

a hammer shaft supported within the housing for axial and rotational movement relative to the housing, the drive shaft connected to the hammer shaft to drive the hammer shaft while allowing axial movement between the drive shaft and hammer shaft;

a second bearing holder fixed on one of the drive shaft and the hammer shaft for rotation with the one of the drive shaft and the hammer shaft, the second bearing holder incorporating plural rotating bearing elements distributed around the second bearing holder in a plane perpendicular to the axis of the drive shaft; and the first bearing holder and the second bearing holder facing each other with the rotating bearing elements of each of the first bearing holder and the second bearing holder engaging each other to impart a hammer action on the hammer shaft as the first bearing holder and second bearing holder rotate against each other under axial load.

12. The hammer drill adapter of claim 11 in which the rotating bearing elements of at least one of the first bearing holder and the second bearing holder are balls.

13. The hammer drill adapter of claim 11 in which the rotating bearing elements of each of the first bearing holder and the second bearing holder are balls.

14. The hammer drill adapter of claim 11 in which the rotating bearing elements of the first bearing holder are radially offset in relation to the rotating bearing elements of the second bearing holder.

15. The hammer drill adapter of claim 11 in which the rotating bearing elements the first bearing holder are fewer in number than the rotating bearing elements of the second bearing holder.

16. The hammer drill adapter of claim 11 in which axial forces are communicated from the drive shaft to the hammer shaft only through contact between the rotating bearing elements of the first bearing holder and the second bearing holder.

17. The hammer drill adapter of claim 16 in which contact between the rotating bearing elements of the first bearing holder and the rotating bearing elements of the second bearing holder occurs at multiple point contacts.

18. The hammer drill adapter of claim 11 further comprising a disengagement mechanism for disengaging the rotating bearing elements of the first bearing holder from the rotating bearing elements of the second bearing holder.

19. The hammer drill adapter of claim 11 in which the drive shaft is the drive shaft of a power tool.

20. The hammer drill adapter of claim 11 in which the second bearing holder is fixed on the hammer shaft.

* * * * *